US011103976B2

(12) United States Patent
Wu

(10) Patent No.: US 11,103,976 B2
(45) Date of Patent: Aug. 31, 2021

(54) CUTTER SHARPENER

(71) Applicants: Race Wu, Taichung (TW); Isaac Vellekamp, Puyallup, WA (US)

(72) Inventor: Race Wu, Taichung (TW)

(73) Assignees: Race Wu, Taichung (TW); Isaac Vellekamp, Puyallup, WA (US)

( * ) Notice: Subject to any disclaimer, the term of this patent is extended or adjusted under 35 U.S.C. 154(b) by 20 days.

(21) Appl. No.: 16/722,697

(22) Filed: Dec. 20, 2019

(65) Prior Publication Data

US 2021/0129293 A1 May 6, 2021

(30) Foreign Application Priority Data

Oct. 31, 2019 (TW) ..... 108214402

(51) Int. Cl.
*B24D 15/08* (2006.01)
*B24D 15/06* (2006.01)

(52) U.S. Cl.
CPC ..... *B24D 15/08* (2013.01); *B24D 15/06* (2013.01); *B24D 15/081* (2013.01)

(58) Field of Classification Search
None
See application file for complete search history.

(56) References Cited

U.S. PATENT DOCUMENTS

| | | | | | |
|---|---|---|---|---|---|
| 1,909,743 | A * | 5/1933 | Blankner | B24D 15/081 | 451/486 |
| 2,124,646 | A * | 7/1938 | Barsch | B24D 15/081 | 451/486 |
| 2,683,385 | A * | 7/1954 | Murchison | B24D 15/081 | 76/86 |
| 6,030,281 | A * | 2/2000 | Cozzini | B24B 41/06 | 451/312 |
| 7,172,500 | B1 * | 2/2007 | Wu | B24D 15/081 | 451/319 |
| 8,944,894 | B2 * | 2/2015 | Smith | B24D 15/081 | 451/552 |
| 10,265,822 | B2 * | 4/2019 | Hammond | B24D 15/08 | |
| D911,809 | S * | 3/2021 | Wu | D8/93 | |
| 2011/0201257 | A1 * | 8/2011 | Walker | B24B 3/54 | 451/45 |
| 2016/0144486 | A1 * | 5/2016 | Bloch | B24D 15/081 | 451/555 |
| 2019/0079264 | A1 * | 3/2019 | Beyda | A45D 42/14 | |

* cited by examiner

*Primary Examiner* — Hwei-Siu C Payer
(74) *Attorney, Agent, or Firm* — Muncy, Geissler, Olds & Lowe, P.C.

(57) ABSTRACT

A cutter sharpener includes a base with a receiving unit, the receiving unit having a pivoting portion and a mounting portion with a positioning section; a support having a pivoting portion pivotally connected to the pivoting portion of the base, a sharpening block mounting portion and a positioning section positioned in the positioning section of the base, and a sharpening block mounted in the sharpening block mounting portion of the support.

9 Claims, 15 Drawing Sheets

CUTTER SHARPENER

BACKGROUND OF THE INVENTION

1. Field of the Invention

The present invention relates to grinding technology and more particularly, to a cutter sharpener.

2. Description of the Related Art

According known cutter sharpeners, the sharpening component must be fixed to the base by fastening members, so it is inconvenient in assembly and disassembly.

Moreover, it is known that conventional cutter sharpeners can only form a single sharpening angle, which cannot meet the needs of different sharpening angles of the user. In addition, there is a need to make a set of different sharpening angles to configure the use, there will still be the same problem.

Therefore, the lack of the conventional cutter sharpeners still needs to be improved.

SUMMARY OF THE INVENTION

The present invention has been accomplished under the circumstances in view. It is the main object of the present invention to provide a cutter sharpener, which provides easy installation of sharpening components that can be easily installed to provide the desired sharpening angle.

To achieve this and other objects of the present invention, a cutter sharpener comprises: a base with a receiving unit, the receiving unit comprising a pivoting portion and a mounting portion, the mounting portion having a positioning section; a support having a pivoting portion pivotally connected to the pivoting portion of the base, a sharpening block mounting portion, and a positioning section for positioning in the positioning section of the base; and a sharpening block installed in the sharpening block mounting portion of the support.

By the feature that the positioning section of the support can be positioned in the positioning section of the base, the cutter sharpener facilitates installation to provide the desired sharpening angle, thereby achieving the purpose of the present invention.

Preferably, the support further comprises an elastic deformation portion connected between the sharpening block mounting portion and the positioning section.

Preferably, the support further comprises a finger grip for finger placement, and the positioning section is located on the finger grip.

Preferably, the mounting portion of the base has a plurality of angle indications, and the support has an angle indication.

Preferably, the receiving unit of the base has two mounting portions arranged opposite to each other, and two supports are respectively installed in the two mounting portions of the receiving unit of the base.

Preferably, the positioning section of the base has a positioning groove, and the positioning section of the support has a positioning head matching the positioning groove of the positioning section of the base.

Preferably, the positioning section of the base has a positioning recess, and the positioning section of the support has a positioning lug matching the positioning recess of the positioning section of the base.

Preferably, the base and the support are pivotally connected by a pivot device, wherein the pivoting portion of the support has a rotation stopper surface; the pivot device comprises a pivot member that has a rotation stopper surface matching the rotation stopper surface of the support.

Preferably, the cutter sharpener further comprises a vacuum suction cup mounted on the base, and a vacuum suction cup operating member operable to drive the vacuum suction cup to suck.

DETAILED DESCRIPTION OF THE INVENTION

Figure 1:
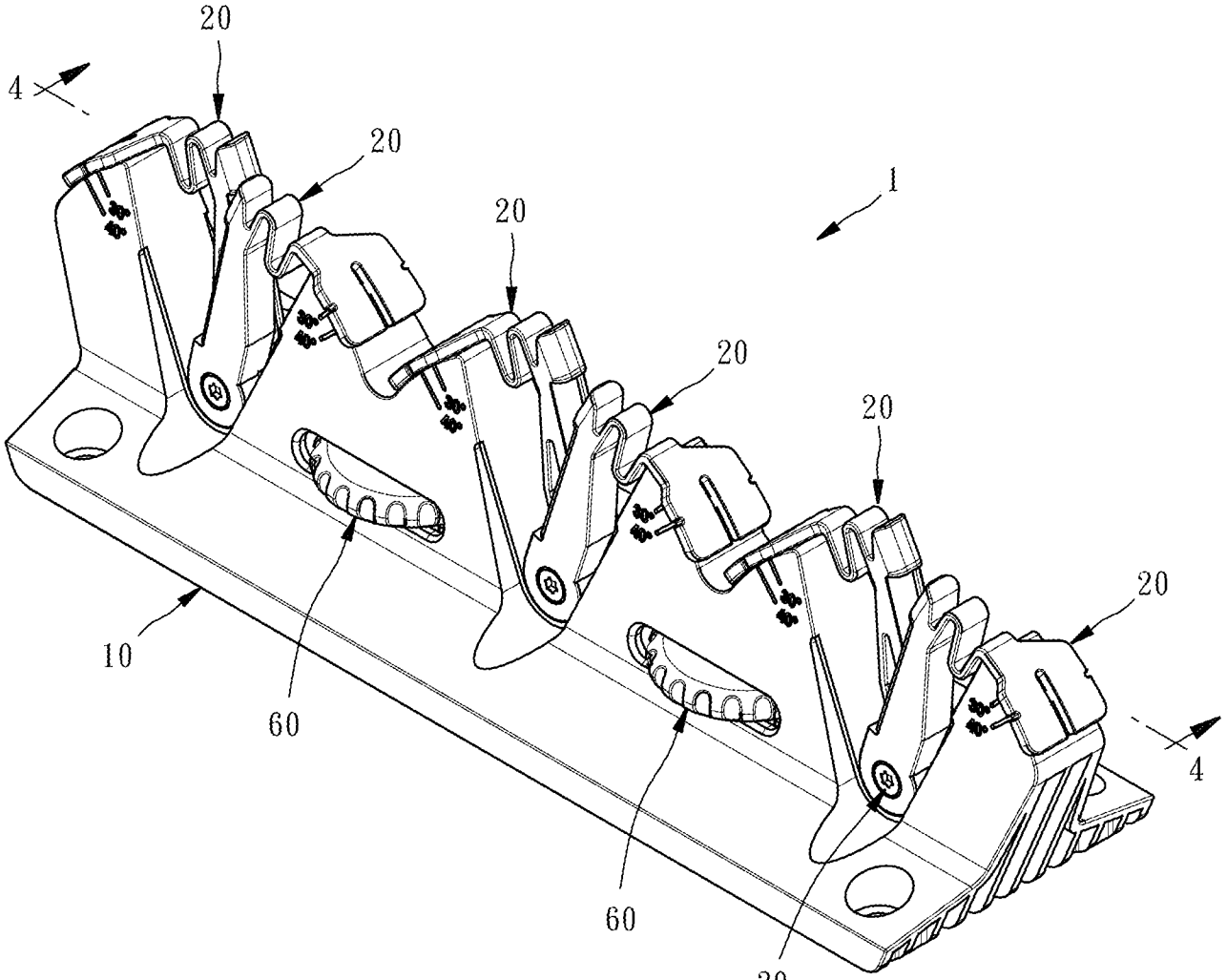
FIG. 1 is an oblique top elevational view of a cutter sharpener in accordance with a first embodiment of the present invention.
Figure 2:
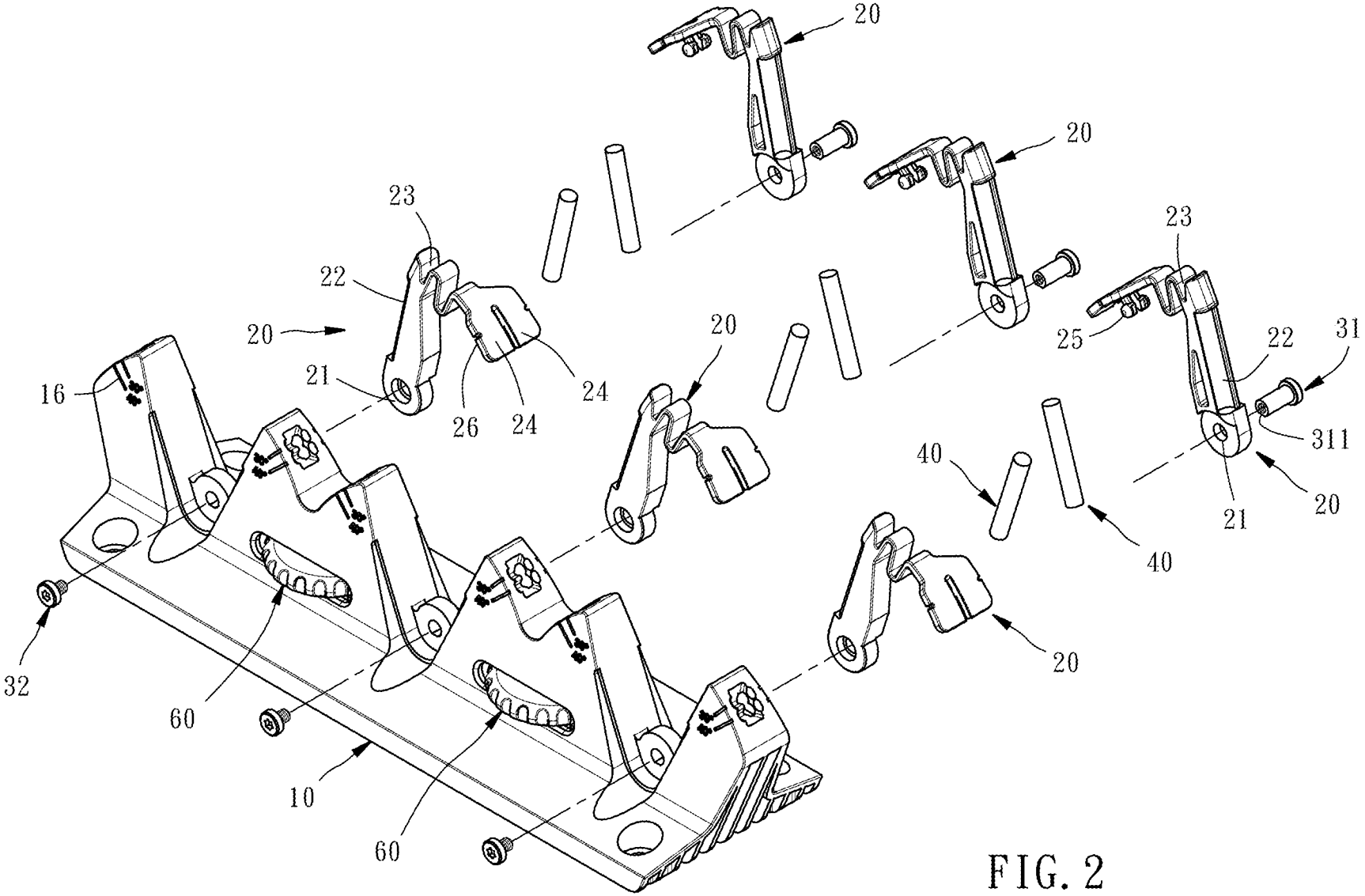
FIG. 2 is an exploded view of the cutter sharpener in accordance with the first embodiment of the present invention.
Figure 3:
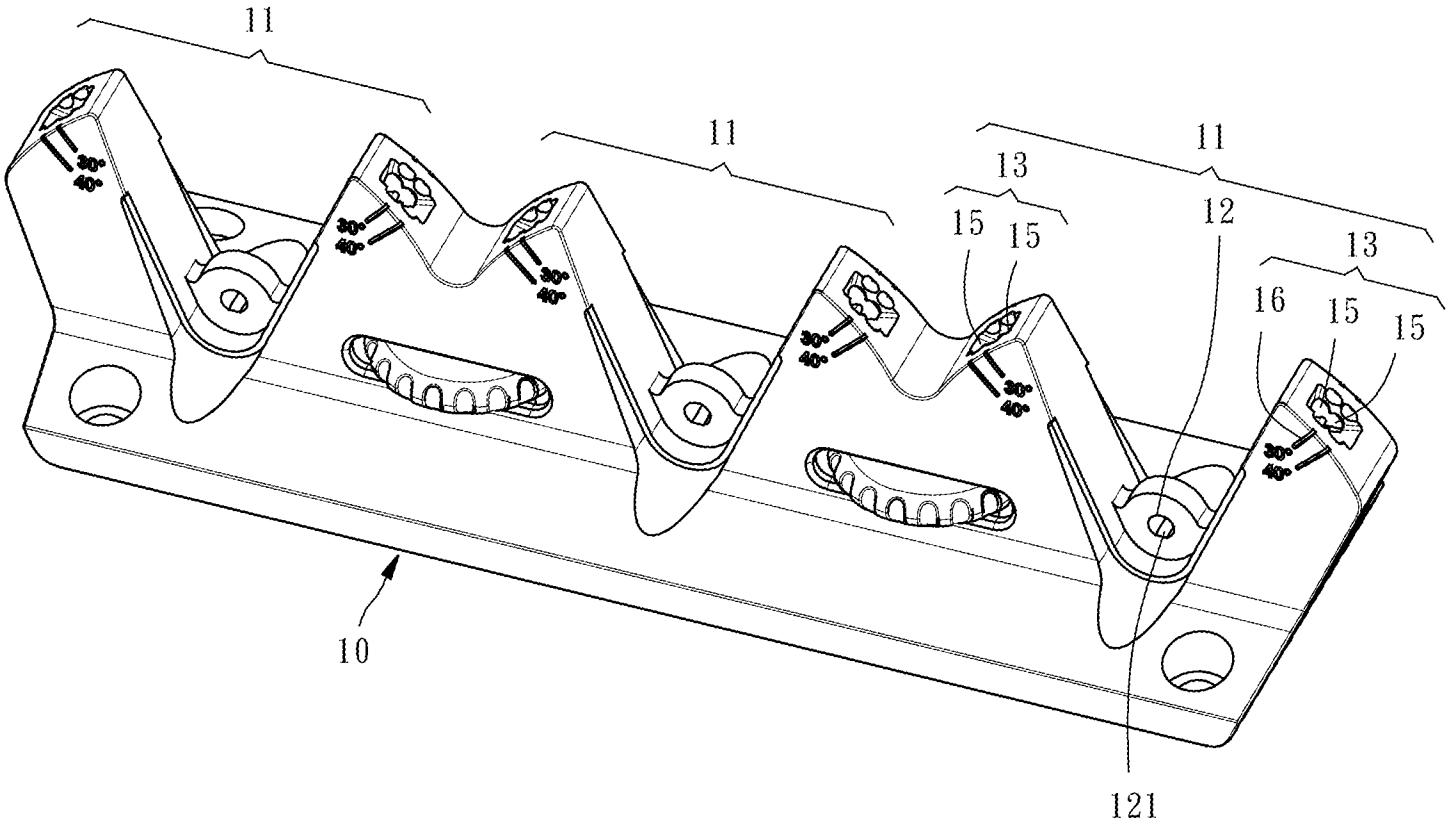
FIG. 3 is an oblique top elevational view of the base of the cutter sharpener in accordance with the first embodiment of the present invention.
Figure 4:
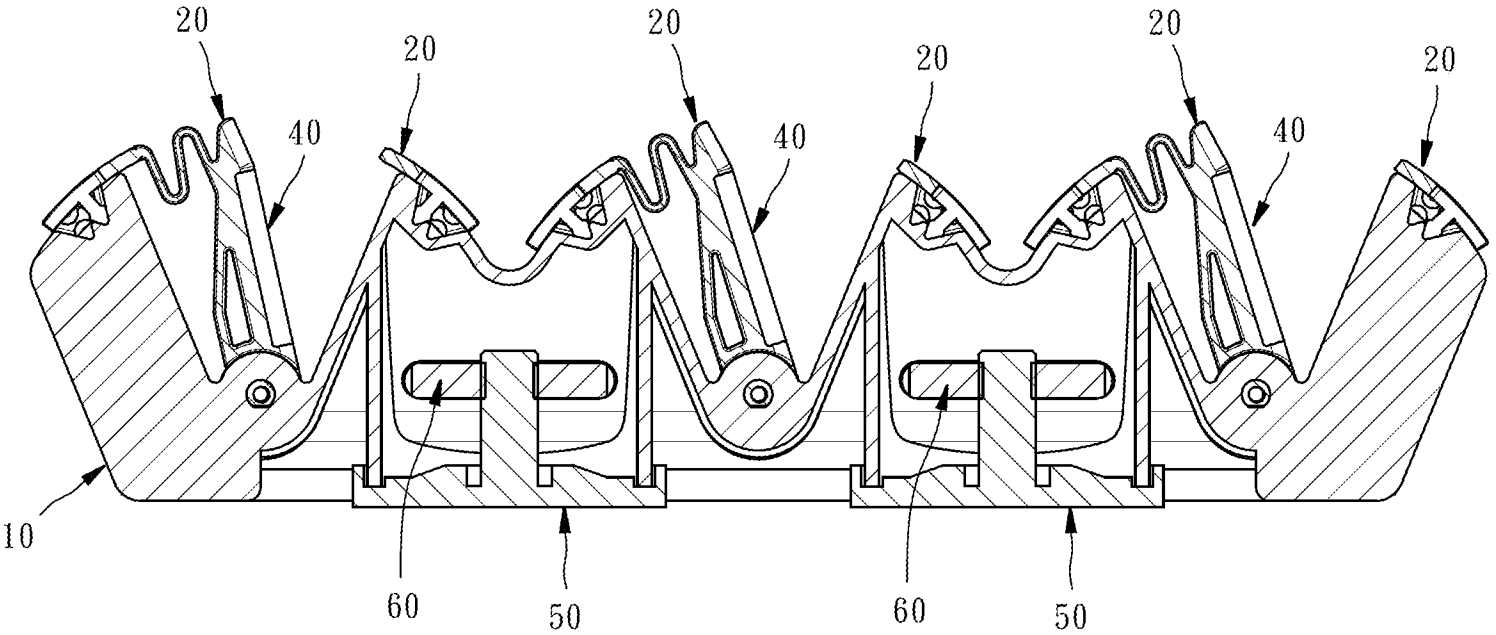
FIG. 4 is a sectional front view of the cutter sharpener in accordance with the first embodiment of the present invention.
Figure 5:
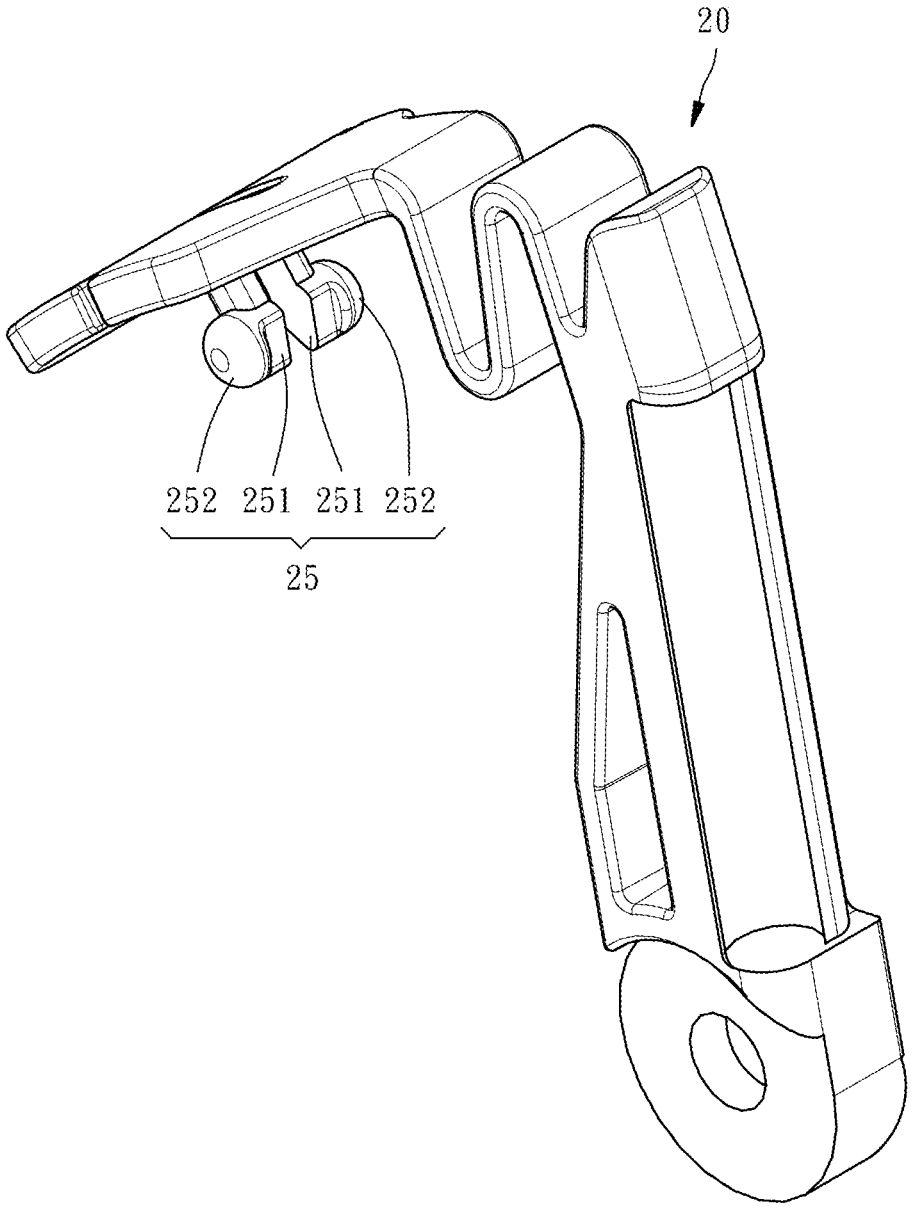
FIG. 5 is an oblique top elevational view, in an enlarged scale, of one support of the cutter sharpener in accordance with the first embodiment of the present invention.
Figure 6:
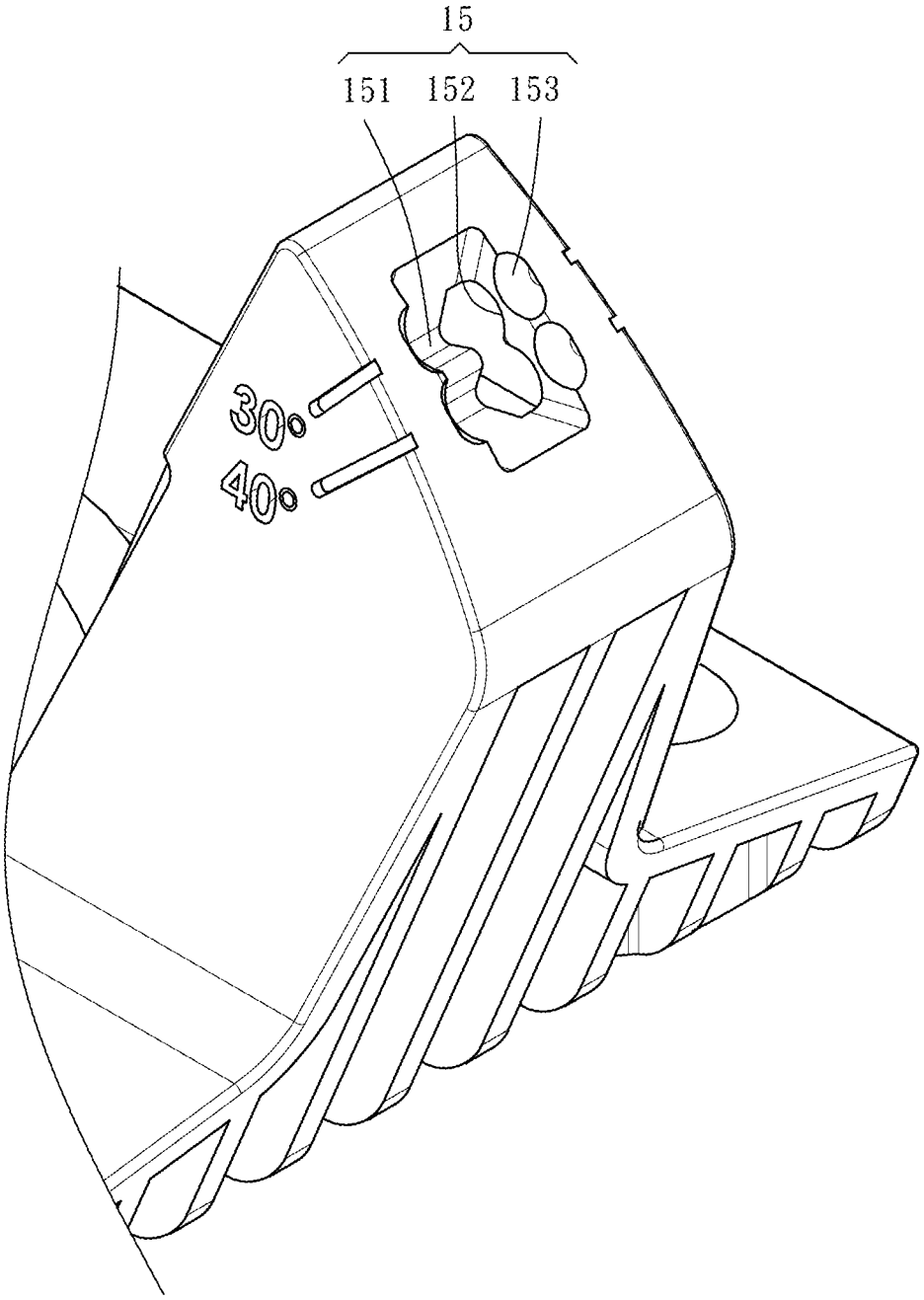
FIG. 6 is an oblique top elevational view, in an enlarged scale, of the base of the cutter sharpener in accordance with the first embodiment of the present invention.
Figure 7:
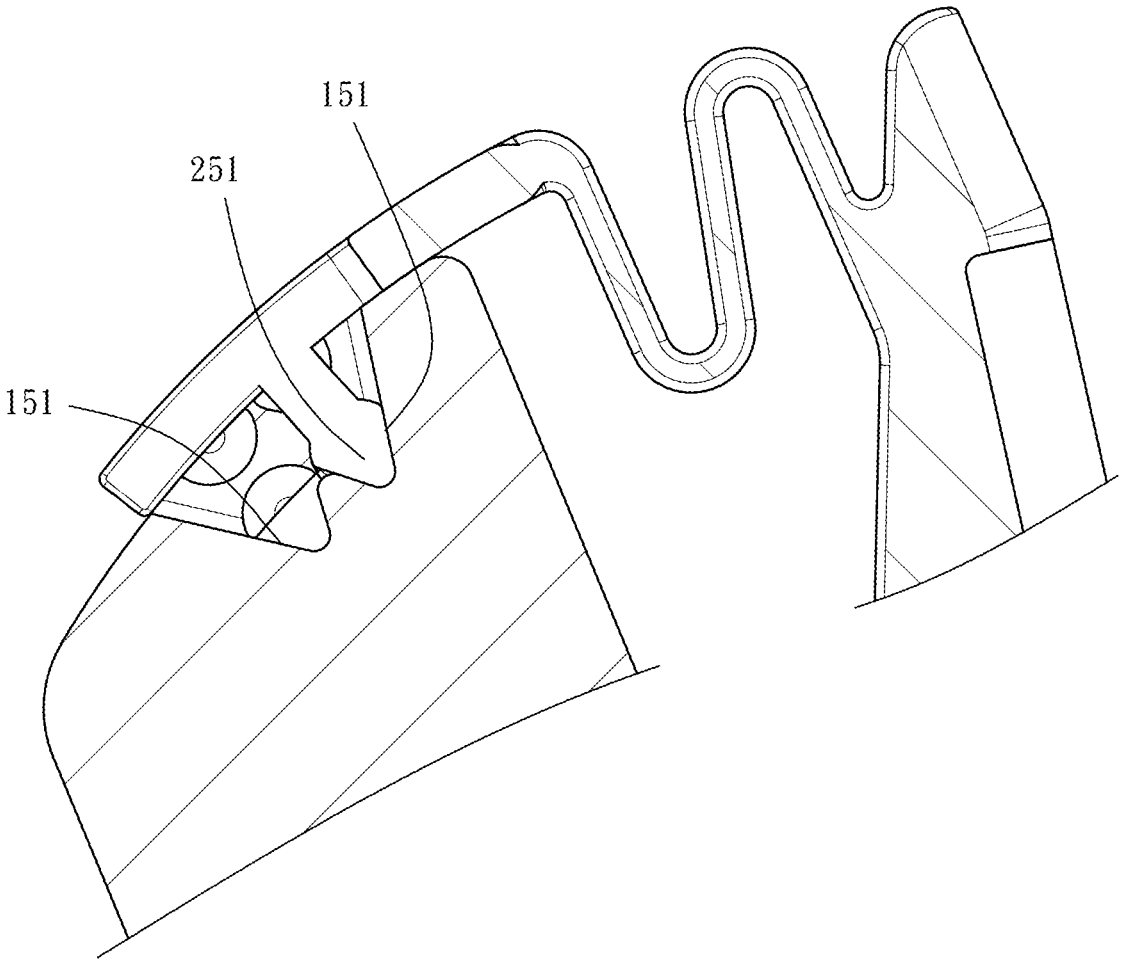
FIG. 7 is an enlarged sectional view of a part of the first embodiment of the present invention, showing the connection between the base and the support.
Figure 8:
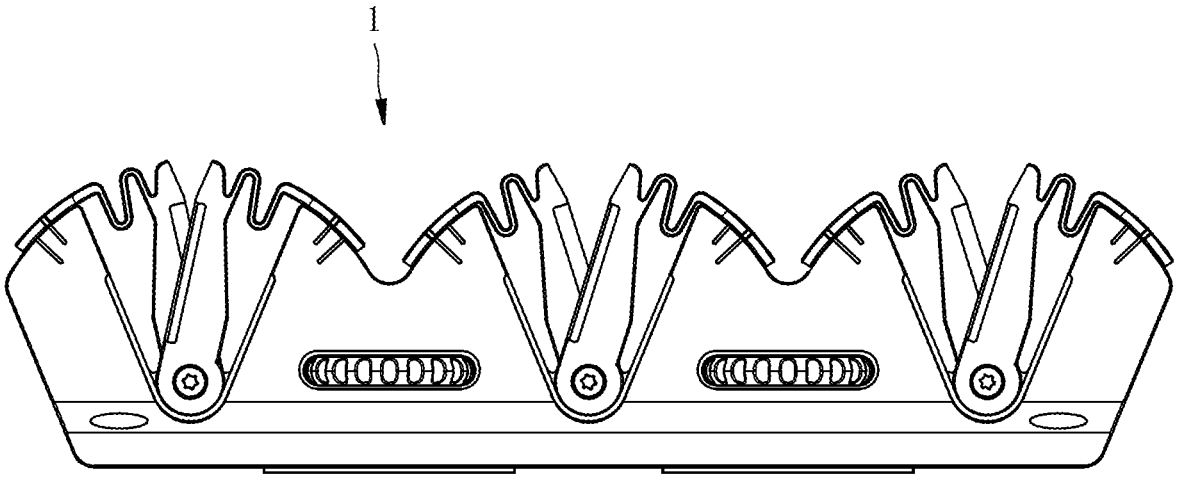
FIG. 8 is a front view of the cutter sharpener in accordance with the first embodiment of the present invention.
Figure 9:
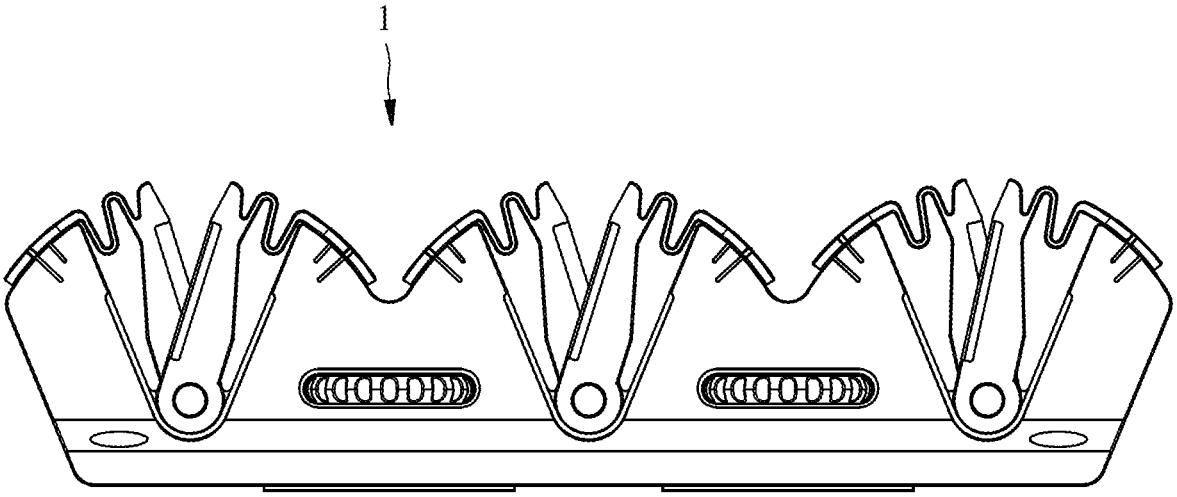
FIG. 9 is a rear view of the cutter sharpener in accordance with the first embodiment of the present invention.
Figure 10:
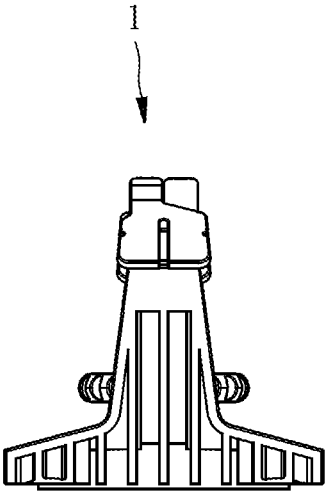
FIG. 10 is a left side view of the cutter sharpener in accordance with the first embodiment of the present invention.
Figure 11:
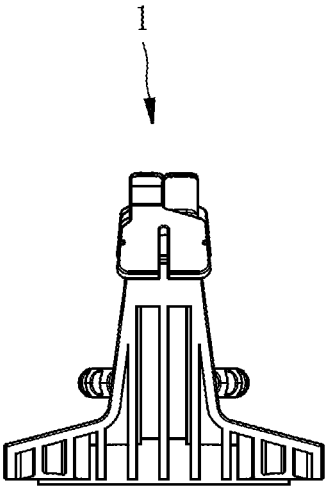
FIG. 11 is a right side view of the cutter sharpener in accordance with the first embodiment of the present invention.
Figure 12:
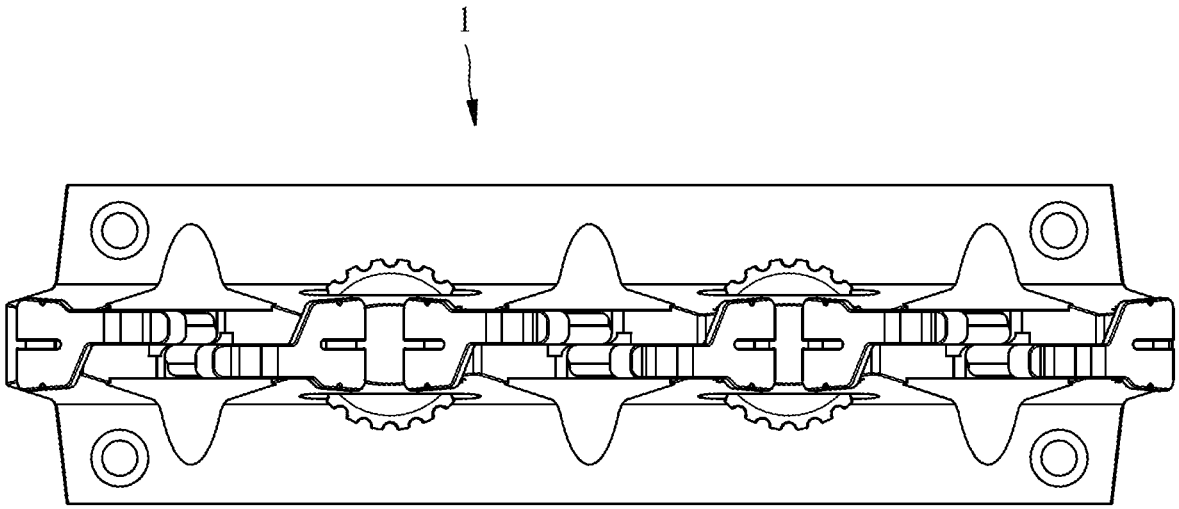
FIG. 12 is a top view of the cutter sharpener in accordance with the first embodiment of the present invention.
Figure 13:
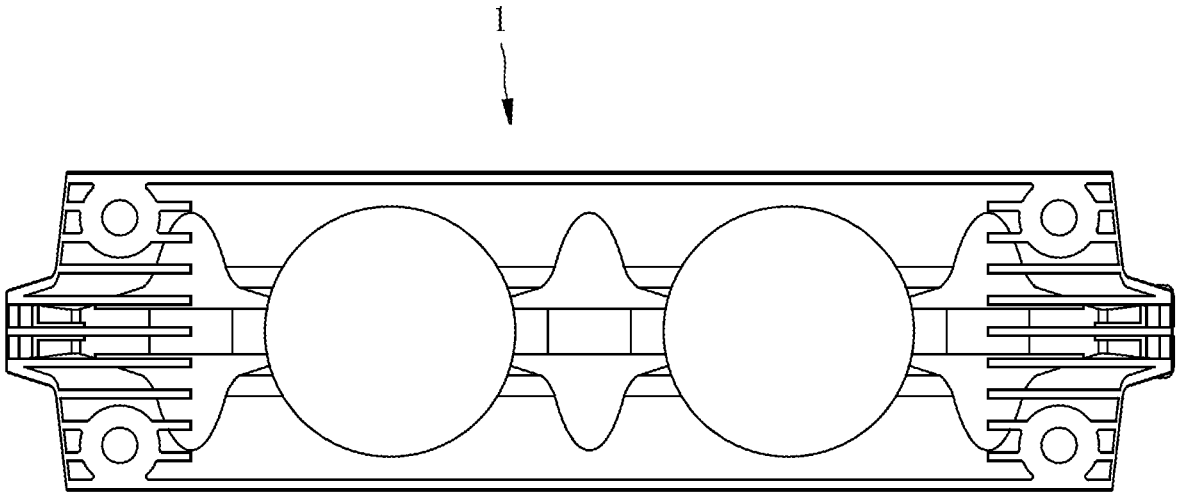
FIG. 13 is a bottom view of the cutter sharpener in accordance with the first embodiment of the present invention.
Figure 14:
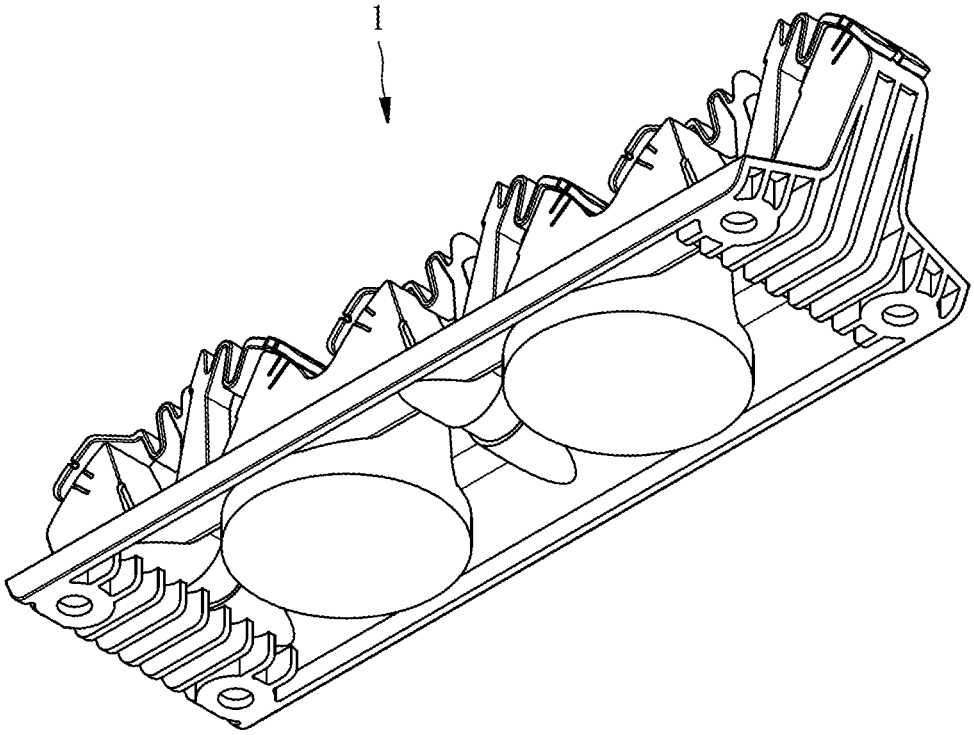
FIG. 14 is an oblique bottom elevational view of the cutter sharpener in accordance with the first embodiment of the present invention.

Referring to FIGS. 1-14, a cutter sharpener (1) provided by a preferred embodiment of the present invention comprises a base (10) with three receiving unit (11), a plurality of supports (20), a plurality of sharpening blocks (40), a plurality of suction cups (50) and a plurality of vacuum suction cup operating members (60).

Each receiving unit (11) of the base (10) comprises a pivoting portion (12) and two mounting portions (13) disposed opposite to each other, and a V-shaped groove and a space are formed between the two mounting portions (13).

Wherein, the pivoting portion (12) is a hole, and a rotation stopper surface (121) is formed in the hole.

Furthermore, each mounting portion (13) has a positioning section (15). Each positioning section (15) has a plurality of positioning grooves (151), a plurality of positioning recesses (152), and a plurality of guiding recesses (153).

In addition, each mounting portion (13) of the base (10) has multiple angle indications (16).

The supports (20) are respectively mounted in the mounting portions (13) of the receiving unit (11) of the base (10); that is, each mounting portion (13) is provided with a support (20).

Each support (20) has a pivoting portion (21) pivotally connected to one respective pivoting portion (12) of the base (10) by a pivot device (30).

Each support (20) also has a sharpening block mounting portion (22), a positioning section (25) for positioning positioned in one respective positioning section (15) of the base (10), and an elastic deformation portion (23) connected between the sharpening block mounting portion (22) and the positioning section (25).

Wherein, the sharpening block mounting portion (22) of each support (20) is a receiving recess, and the elastic deformation portion (23) is wave-shaped in a preferred embodiment of the present invention.

In this embodiment, each two supports (20) are arranged opposite to each other.

In this embodiment, multiple supports (20) are provided, and the sharpening blocks (40) corresponding to each receiving unit (11) can have the same grit size or different grit sizes.

In this embodiment, multiple supports (20) are provided, and the installation or adjustment angle interval of each support (20) corresponding to each receiving unit (11) can be the same or different.

Wherein the base (10) provides multiple positioning sections (15) for the positioning of the positioning sections (25) of the supports (20) in an adjustable manner.

Wherein each support (20) has a finger grip (24) for finger displacement, and the finger grip (24) can be separated by slots to form two or more pieces.

Wherein each positioning section (15) of the base (10) is a groove, and the positioning section (25) of each support (20) is a bump.

In one embodiment, each positioning section (15) of the base (10) has a positioning groove (151), and the positioning section (25) of each support (20) has a positioning head (251) matching one respective positioning groove (151) of the base (10).

In one embodiment, each positioning section (15) of the base (10) has a positioning recess (152), and the positioning section (25) of each support (20) has a positioning lug (252) matching one respective positioning recess (152) of the base (10).

Wherein the guiding recess (153) is available for the respective positioning lug (252) as a guide to make it easier to enter.

Also, each support (20) has an angle indication (26) that corresponds to the angle indications (16) of base (10).

The pivot device (30) consists of a first pivot member (31) and a second pivot member (32), and the first pivot member (31) has a rotation stopper surface (311) corresponding to one respective rotation stopper surface (121) of the base (10).

The sharpening blocks (40) are respectively disposed on the sharpening block mounting portions (22) of the supports (20), each forming an oblique sharpening angle.

The suction cups (50) are mounted on the base (10).

The vacuum suction cup operating members (60) are mounted on the base (10) to allow the vacuum suction cups (50) to be sucked or not.

The positioning sections (25) of the supports (20) can be positioned in the respective positioning sections (15) of the base (10), facilitating easy installation to provide the desired sharpening angle, thus achieving the purpose of the present invention.

The matching structure between the positioning sections (15) of the base (10) and the positioning sections (25) of the supports (20) can prevent or reduce the shaking in all directions, which is more beneficial to sharpening the cutter.

Figure 15:
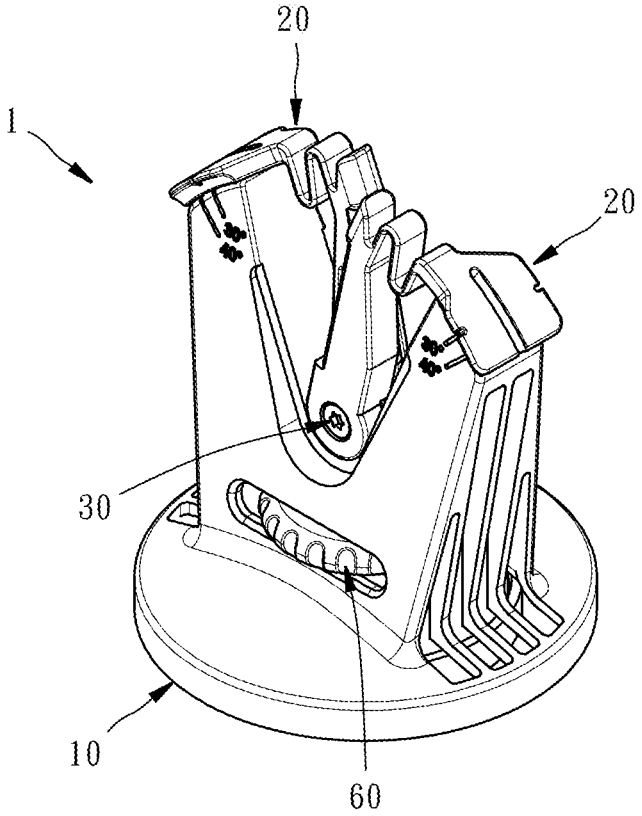
FIG. 15 is an oblique top elevational view of a cutter sharpener in accordance with a second embodiment of the present invention.
Figure 16:
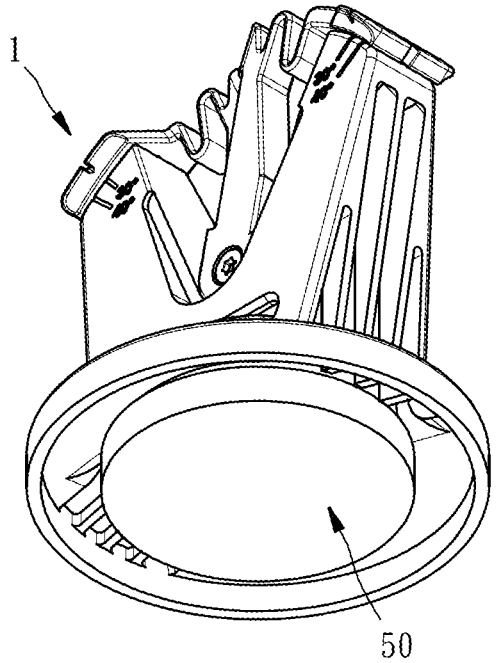
FIG. 16 is an oblique bottom elevational view of the cutter sharpener in accordance with the second embodiment of the present invention.
Figure 17:
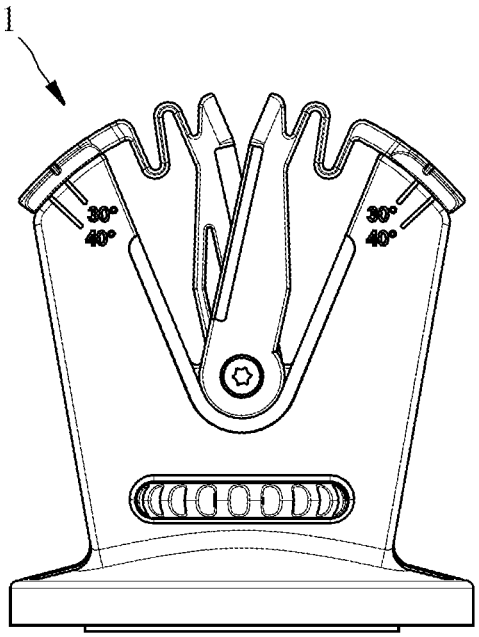
FIG. 17 is a front view of the cutter sharpener in accordance with the second embodiment of the present invention.
Figure 18:
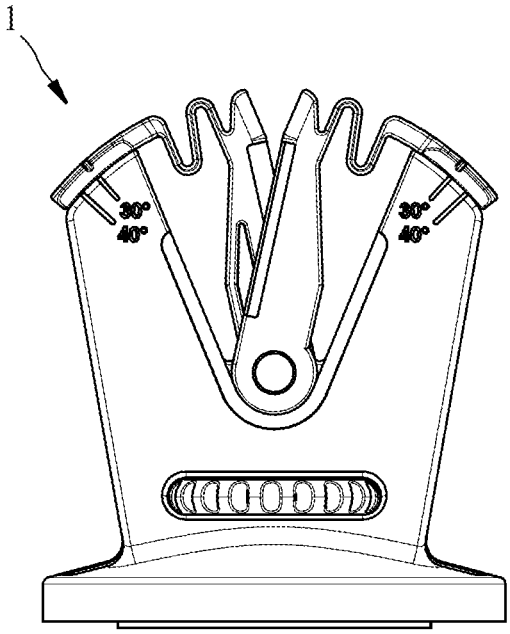
FIG. 18 is a rear view of the cutter sharpener in accordance with the second embodiment of the present invention.
Figure 19:
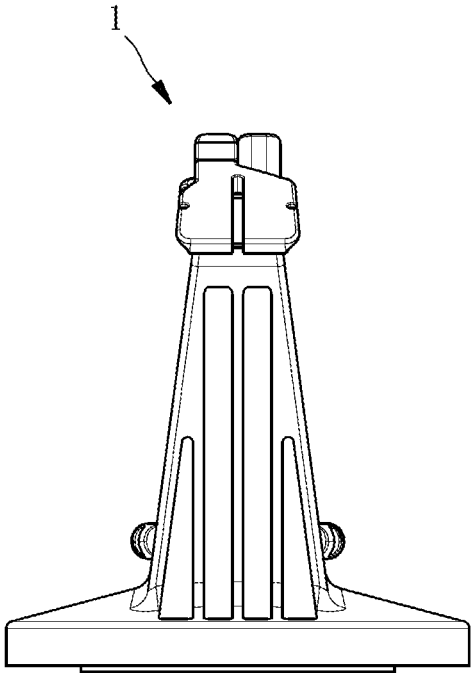
FIG. 19 is a left side view of the cutter sharpener in accordance with the second embodiment of the present invention.
Figure 20:
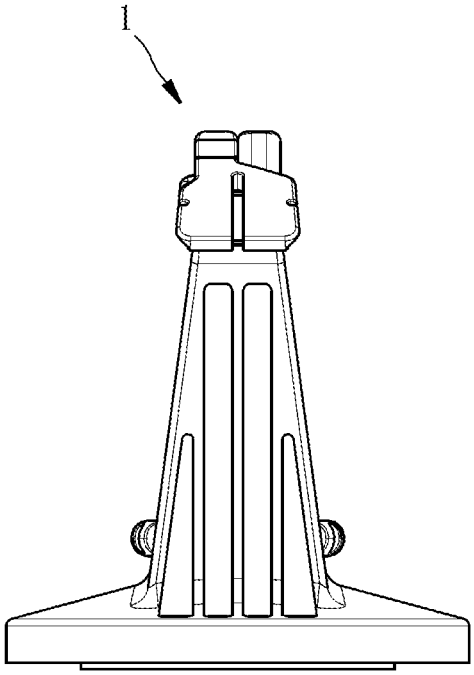
FIG. 20 is a right side view of the cutter sharpener in accordance with the second embodiment of the present invention.
Figure 21:
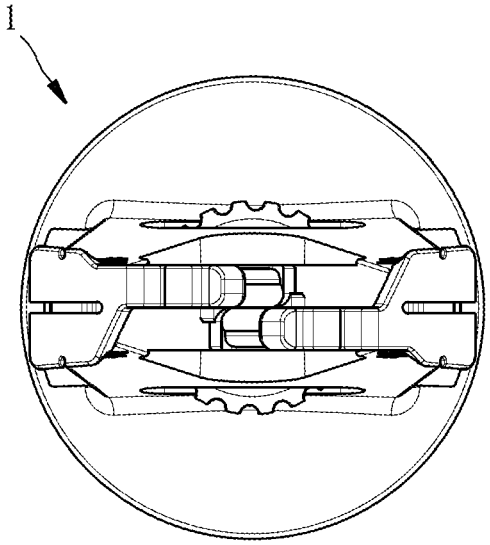
FIG. 21 is a top view of the cutter sharpener in accordance with the second embodiment of the present invention.
Figure 22:
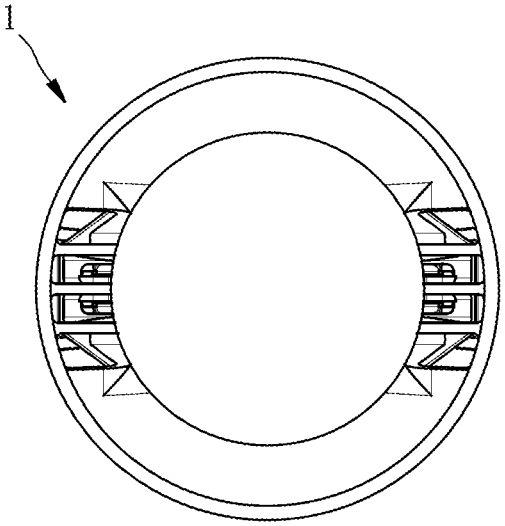
FIG. 22 is a bottom view of the cutter sharpener in accordance with the second embodiment of the present invention.

As shown in FIG. 15 to FIG. 22, a cutter sharpener provided by another preferred embodiment of the present invention is different from the previous embodiment in that:

The base (10) has only one receiving unit (11) with a set of opposite supports (20) and sharpening blocks (40) mounted therein.

In addition, the vacuum suction cups (50) and the vacuum suction cup operating members (60) are located directly below the pivoting portions (21) of the supports (20).

Similarly, the positioning sections (25) of the supports (20) are respectively positioned in the positioning sections (15) of the base (10), facilitating easy installation to provide the desired sharpening angle, thus achieving the purpose of the present invention.

In addition to the above embodiments, the present invention can also be implemented as follows:

For example, the supports (20) are not limited to the opposite setting but can also be set only on one side.

Alternatively, each support (20) corresponding to each receiving unit (11) is not limited to the same angular interval configuration, and the installation or adjustment angle interval of each support (20) corresponding to each receiving unit (11) may also be different.

In summary, by the feature that the positioning sections (25) of the supports (20) can be respectively positioned in the positioning sections (15) of the base (10), the invention facilitates the installation of the cutter sharpener to provide the desired sharpening angle. Therefore, the purpose of the invention is achieved.

What is claimed is:

1. A cutter sharpener (1), comprising:

a base (10) comprising at least one receiving unit (11), each said receiving unit (11) comprising a pivoting portion (12) and a mounting portion (13), said mounting portion (13) comprising at least one positioning section (15);

at least one support (20) each comprising a pivoting portion (21) pivotally connected to one respective said pivoting portion (12) of said receiving unit (11), a sharpening block mounting portion (22) and a positioning section (25) for positioning in one respective said positioning section (15) of said mounting portion (13); and at least one sharpening block (40) respectively mounted in said sharpening block mounting portion (22) of one respective said support (20);

wherein each said support (20) further comprises a finger grip (24) for finger displacement and said positioning section (25) of each said support (20) is located on its associating said finger grip (24).

2. The cutter sharpener as claimed in claim 1, wherein each said mounting portion (13) of said receiving unit (11) comprises a plurality of said positioning sections (15) for the positioning of said positioning section (25) of one respective said support (20) i-sin a selective manner.

3. The cutter sharpener as claimed in claim 1, wherein each said support (20) further comprises an elastic deformation portion (23) connected between said sharpening block mounting portion (22) and said positioning section (25) of said support (2).

4. The cutter sharpener as claimed in claim 1, wherein each said mounting portion (13) of said receiving unit (11) comprises an angle indication (16); each said support (20) further comprises an angle indication (26).

5. The cutter sharpener as claimed in claim 1, wherein each said receiving unit (11) of said base (10) comprises two said mounting portions (13) arranged opposite to each other; two said supports (20) are respectively mounted in the two said mounting portions (13) of each said receiving unit (11) of said base (10).

6. The cutter sharpener as claimed in claim 1, wherein each said positioning section (15) of said mounting portion (13) comprises a positioning groove (151); said positioning section (25) of each said support (20) comprises a positioning head (251) matching said positioning groove (151) of one respective said positioning section (15) of said mounting portion (13).

7. The cutter sharpener as claimed in claim 1, wherein each said positioning section (15) of said mounting portion (13) comprises a positioning recess (152); said positioning section (25) of each said support (20) comprises a positioning lug (252) matching said positioning recess (152) of one respective said positioning section (15) of said mounting portion (13).

8. The cutter sharpener as claimed in claim 1, further comprising at least one pivot device (30) respectively pivotally connecting said pivoting portion (21) of each said support (20) to one respective said pivoting portion (12) of said receiving unit (11), wherein said pivoting portion (12) of each said receiving unit (11) of said base (10) comprises a rotation stopper surface (121); each said pivot device (30) comprises a pivot member (31), said pivot member comprising a rotation stopper surface (311) matching said rotation stopper surface (121) of said pivoting portion (12) of each said receiving unit (11) of said base (10).

9. The cutter sharpener as claimed in claim 1, further comprising at least one vacuum suction cup (50) mounted on said base (10), and at least one vacuum suction cup operating member (60) operable to drive said at least one vacuum suction cup (50) to suck to a surface.

* * * * *